United States Patent [19]

Patton, Sr.

[11] Patent Number: 4,766,612

[45] Date of Patent: Aug. 30, 1988

[54] PROTECTIVE WORK GLOVE

[76] Inventor: Edward E. Patton, Sr., 5080 Fremont Ave., Jacksonville, Fla. 32210

[21] Appl. No.: 7,489

[22] Filed: Jan. 28, 1987

[51] Int. Cl.[4] ..... A41D 19/00

[52] U.S. Cl. ..... 2/161 R; 2/159; 2/163

[58] Field of Search ..... 2/161 R, 158, 159, 160, 2/163, 164, 168, 169, 16, 21

[56] References Cited

U.S. PATENT DOCUMENTS

| | | | |
|---|---|---|---|
| 1,951,190 | 3/1934 | Gambee | 2/161 R |
| 2,025,357 | 12/1935 | Pagan | 2/161 R |
| 2,083,935 | 6/1937 | Arnold | 2/161 R |
| 3,228,035 | 1/1966 | Davis | 2/161 R |
| 3,416,158 | 12/1968 | Kulman | 2/161 R |
| 3,732,575 | 5/1973 | Pakulak | 2/161 R |
| 4,272,849 | 6/1981 | Thurston et al. | 2/161 R X |

*Primary Examiner*—Louis K. Rimrodt
*Assistant Examiner*—J. L. Olds
*Attorney, Agent, or Firm*—Arthur G. Yeager

[57] ABSTRACT

A work glove in combination with stiff protective members fitting around the back of each finger and the back of the hand and being removably insertable into cavities in the glove. This glove is designed principally to protect the hand and fingers against crushing injury. The protective members may be attached directly to the glove or to a liner insertable into the glove.

35 Claims, 4 Drawing Sheets

FIG. 17
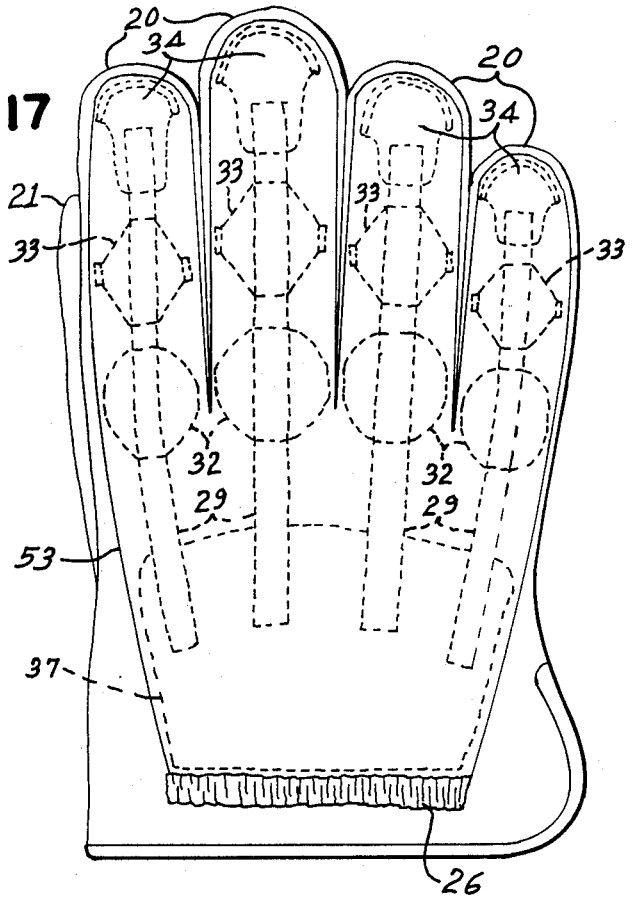
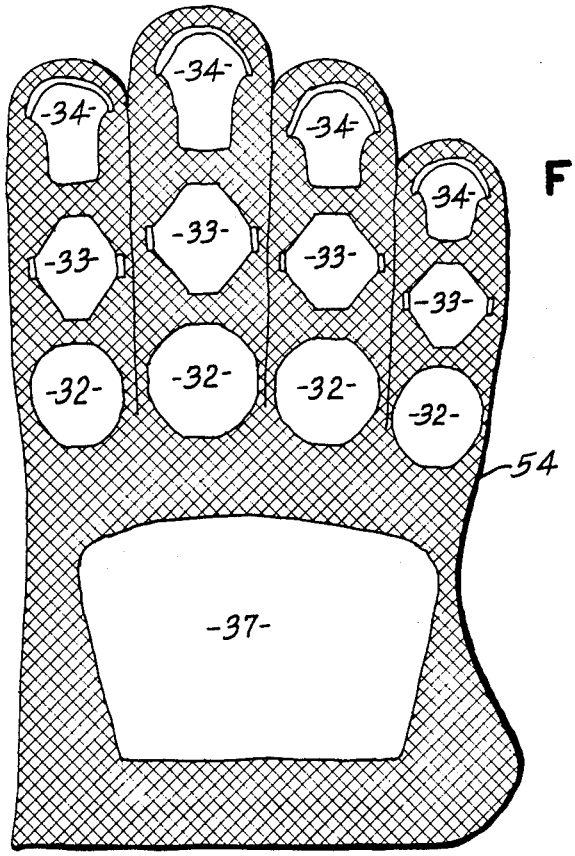
FIG. 18

PROTECTIVE WORK GLOVE

BACKGROUND OF THE INVENTION

Workers in mines, quarries, and certain other industries are frequently subject to the risk of mashing or crushing their hands and fingers when handling heavy objects. There has been in the prior art no satisfactory protection against such injuries other than to keep the hands and fingers out of the danger area. This invention provides a protective glove that permits the hands to be used in dangerous areas with substantially reduced incidence of bruised, mashed, broken or other injury to the fingers or hands.

It is an object of this invention to provide an improved work glove provided with means to protect the hands and fingers from mashing or crushing type of injury. It is another object of this invention to provide a novel protective work glove with an insertable articulated structure of finger protective elements and a hand protective element. Still other objects can be found in the more detailed description which follows.

BRIEF SUMMARY OF THE INVENTION

This invention relates to a protective work glove comprising a glove with finger and hand protective members insertable therein; said finger protective members each comprising a plurality of stiff channel members adapted to fit around the back of the finger and joined to each other by a flexible connector extending lengthwise along the back of the finger and said hand protective member comprising a curved stiff plate member adapted to fit over the back of the hand.

In preferred embodiments of the invention the protective members are joined to make a single articulated protective unit which is removably inserted into pockets on the back of the glove.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 17 is a second embodiment of the glove of this invention; and

FIG. 18 is a third embodiment of the glove of this invention.

DETAILED DESCRIPTION OF THE INVENTION

Figure 1:
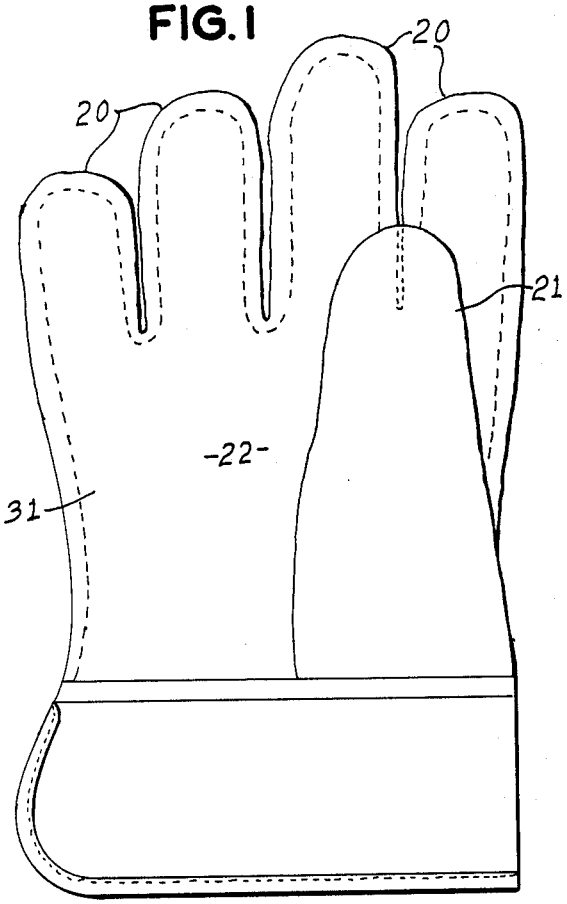
FIG. 1 is a top plan view looking at the palm of the glove of this invention.
Figure 2:
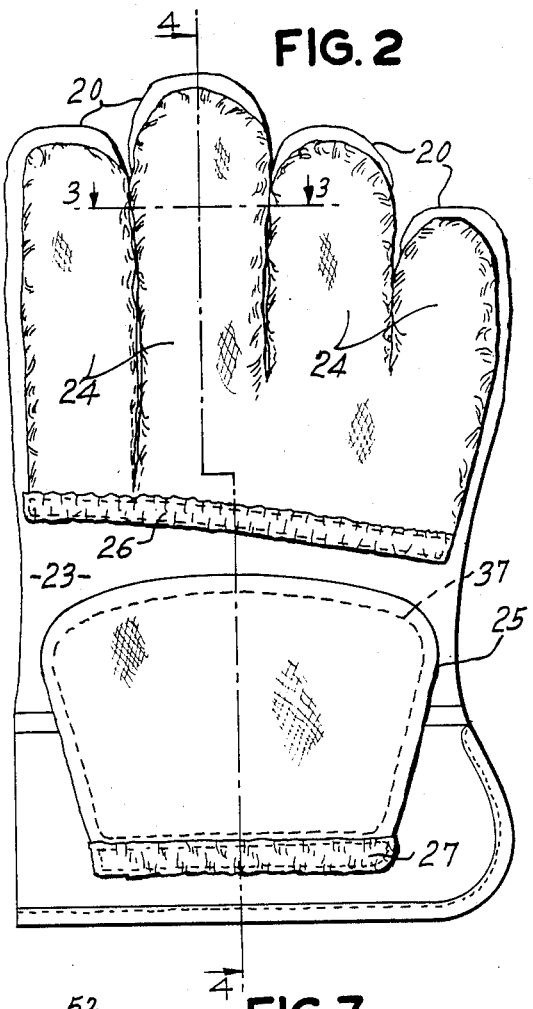
FIG. 2 is a bottom plan view looking at the back of the glove in one embodiment of this invention.
Figure 4:
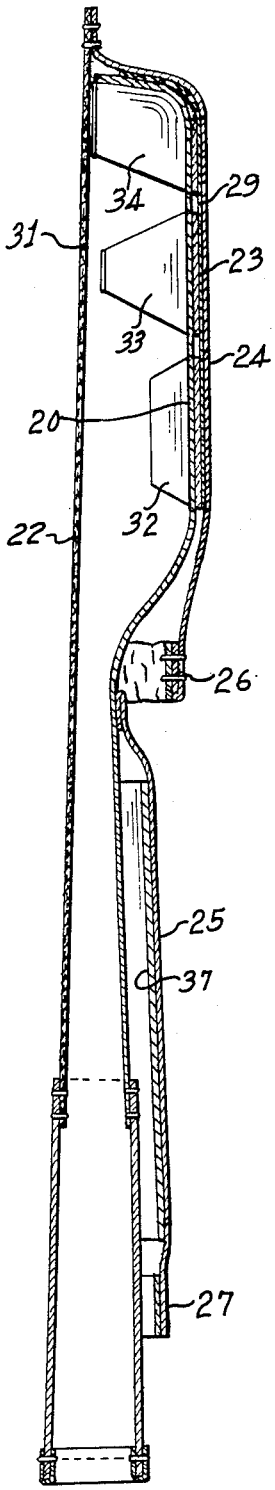
FIG. 4 is a cross sectional view taken at 4—4 of FIG. 2.
Figure 3:
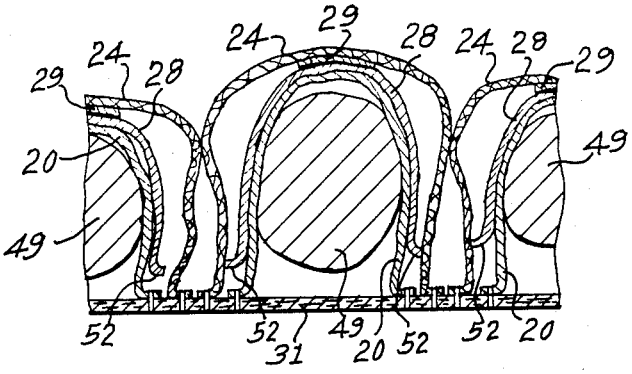
FIG. 3 is a cross sectional view taken at 3—3 of FIG. 2.
Figure 5:
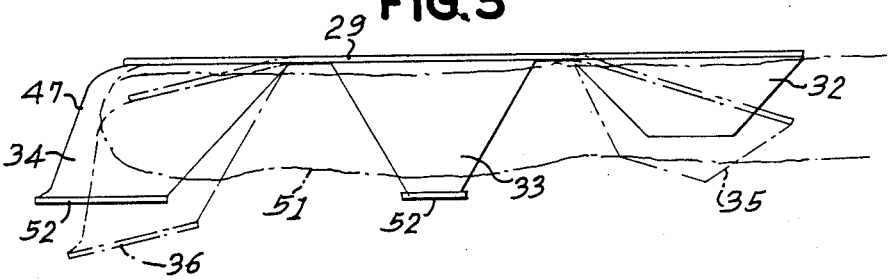
FIG. 5 is a side elevational view of one embodiment of an articulated finger protective element.
Figure 13:
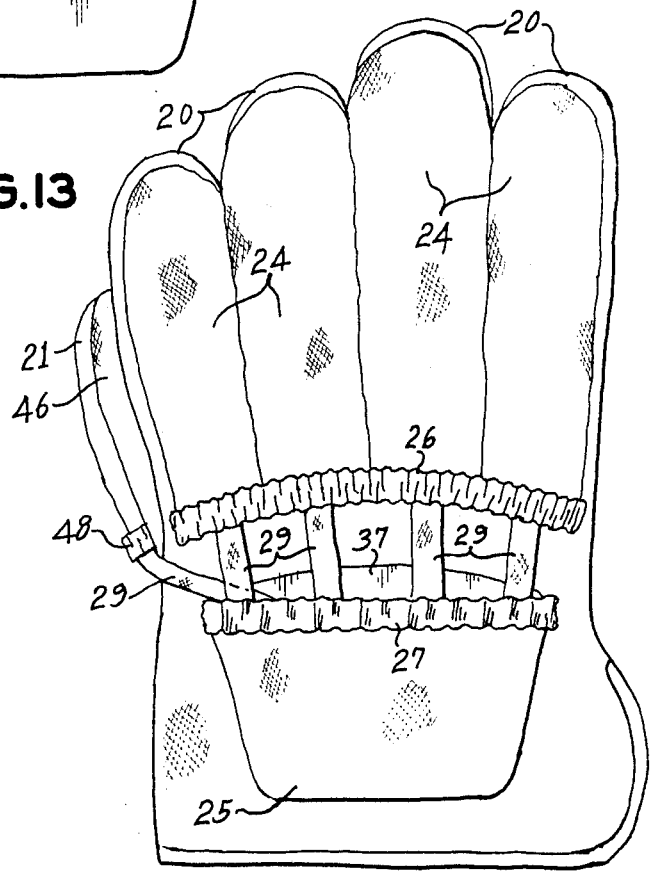
FIG. 13 is a bottom plan view of a glove containing the protective unit of FIG. 12.

The general features of the invention are best understood by reference to FIGS. 1–6 of the attached drawings. In FIGS. 1 and 2 there is shown a work glove from the palm side 22 (FIG. 1) and from the back side 23 (FIG. 2). Normally such a glove has a leather palm 31 and the remainder of the glove on back side 23 is a canvas fabric. The canvas is sewn to the leather palm 31 to form four finger receiving cavities 20 and a thumb cavity 21. In the improved glove of the present invention there are additional pockets 24 added on top of the finger cavities 20 of substantially the same size and shape as cavities 20. Similarly, a thumb pocket 46 (see FIG. 13) may be added to the back side of thumb cavity 21. Pocket 25 is also added to back side 23 to receive hand protective member 37 which covers the back of the hand. Into each pocket 24 is inserted a finger protective element as shown in FIGS. 3–5 and a thumb protective element (see FIG. 6) may be inserted into a pocket like 46 of FIG. 13. The protective element includes a plurality of U-shaped channel members 32, 33, and 34 or 38 and 39 (in the case of the thumb) joined to each other by a bendable or flexible connector 29 so as to make each protective element articulated. As seen in FIG. 5 the finger element is flexible to permit the first, second, and third phalanges of each finger to be protected by members 32, 33, and 34, respectively, even though the three knuckles of each finger are bent so as to place members 32 and 36 in a bent position as at 35 and 36 of FIG. 5. Member 34 is closed over the forward end 47 of the finger and member 39 is closed over the forward end 47 of the thumb to cover and protect the tip of the finger or thumb and the nail. Members 32, 33, and 38 are open ended to permit the member to fit over the respective phalange in the same fashion that a saddle fits over a horse's back. Each of members 33 and 34 is deep enough to cover the entire thickness of the finger 51 as shown in FIG. 5, while member 32 covers only the top half of the finger. Members 33 and 34 have flanges 52 to assist in providing stiffness to these members. Member 32 has no flange 52 and covers only the top of the finger because it would otherwise pinch the web of skin between fingers where they join the hand. Similarly thumb member 39 has a flange member 52 while member 38 has no flange. These finger and thumb protective elements are inserted into the respective pockets 24 and thumb pocket 46 on the back side 23 of the glove. An elastic tape 26 along the lower edge of pockets 24 releasably retains the protective elements in their respective pockets. A similar tape 48 is shown in FIG. 13 to releasably retain the thumb element in its pocket 46.

Pocket 25 on back side 23 is designed to receive hand protective member 37 therein. Member 37 is a curved plate, generally of a conical section, which conforms to the back of the hand. Pocket 25 preferably includes an elastic tape 27 for releasably retaining member 37 in pocket 25.

Figure 6:
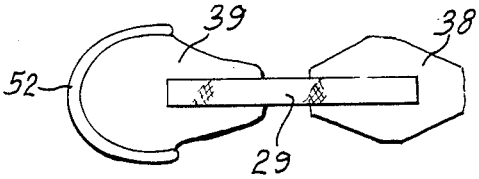
FIG. 6 is a top plan view of an articulated thumb protective element.
Figure 12:
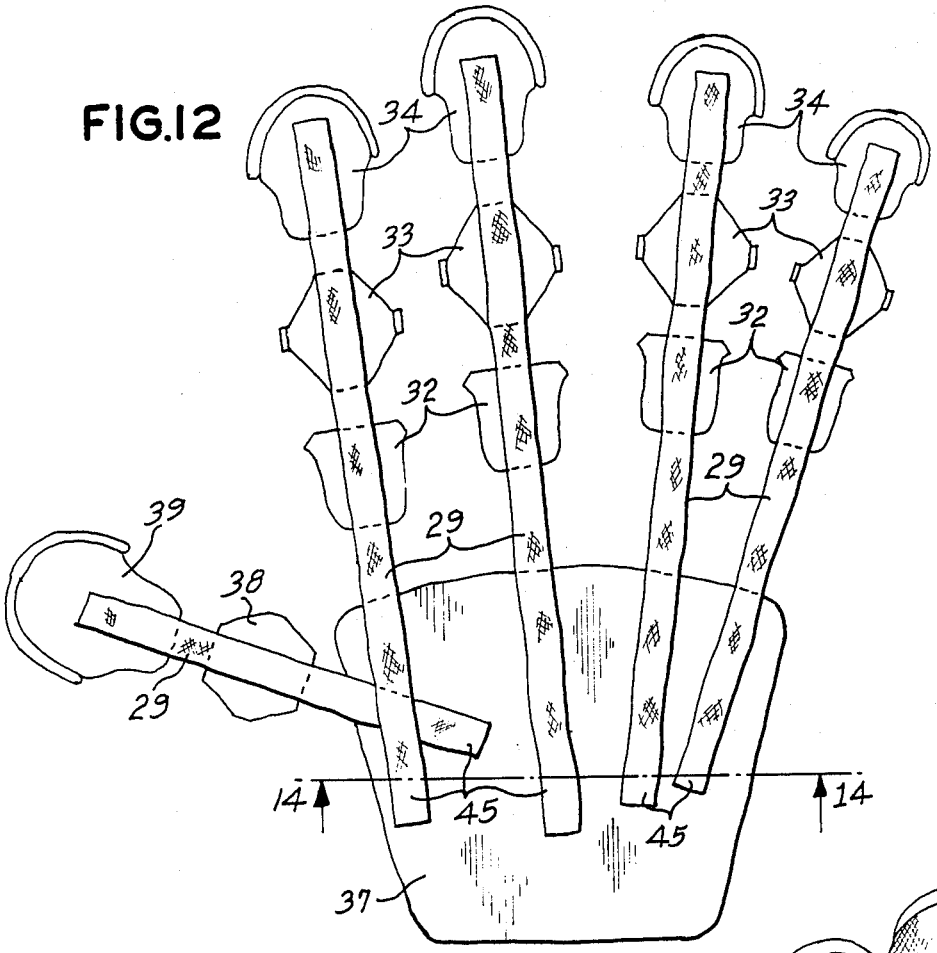
FIG. 12 is a top plan view of a fifth embodiment of an articulated unit according to the invention including a thumb protective element, four finger protective elements, and a hand protective element.
Figure 14:
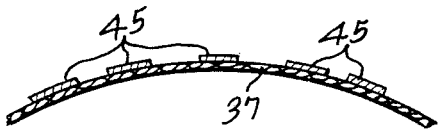
FIG. 14 is a cross sectional view taken at 14—14 of FIG. 12.

In the embodiment described above each finger element is a separate unit as shown in FIG. 5, each thumb element as shown in FIG. 6 is a separate unit, and hand protective member 37 is a separate unit. Thus there are six separate protective units inserted into six separate pockets on the glove. In FIGS. 12–14 there is shown an embodiment where all six elements are joined into one articulated unit. This is accomplished by merely extending flexible connectors 29 to be attached to hand protective member 37 as at 45 (FIG. 12). The only modification in the glove which is required by this embodiment is that pocket 25 is oriented with its open side upward and bordered with elastic tape 27. This orientation permits connectors 29 to extend from the finger protective elements and the thumb protective element to hand protective member 37.

FIG. 3 shows how fingers 49 of the glove wearer are inside cavities 20 of the glove, with finger channel member 28 fitting around cavity 20 and snugly covers fingers 49 therein, and pockets 24 enclose channel members 28. FIG. 4 shows the same arrangement in a longitudinal section although fingers 49 have not been included.

Figure 9:
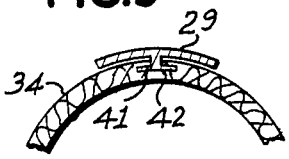
FIG. 9 is a cross sectional view taken at 9—9 of FIG. 8.
Figure 7:
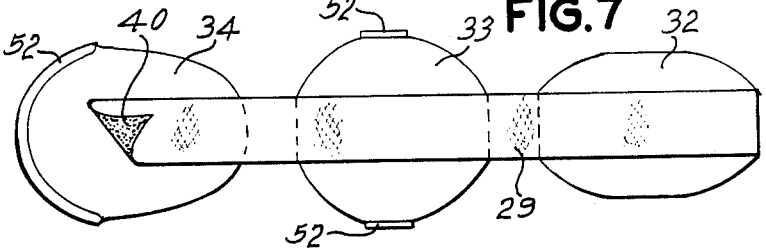
FIG. 7 is a top plan view of a second embodiment of a finger protective element.
Figure 8:
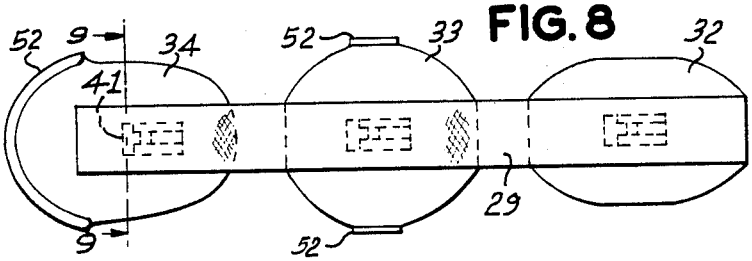
FIG. 8 is a top plan view of a third embodiment of a finger protective element.

In FIGS. 7–11 there are shown three embodiments of attaching channel members 32, 33, 34, 38, and 39 to a flexible strip material 29. In FIG. 7 strip 29 is attached to channel members 32, 33 and 34 by means of a suitable adhesive 40 or by sonic or thermal welds or the like. In FIGS. 8 and 9 there is shown a sliding connection between members 32, 33, and 34 and strip 29. T-shaped tongues 41 depend downwardly from strip 29 and mate with T-shaped grooves 42 in the top outside of members 32, 33, and 34. This embodiment provides a certain degree of longitudinal adjustment for members 32, 33, and 34 to accommodate different positions as the fingers of the wearer are bent or straightened.

Figure 11:
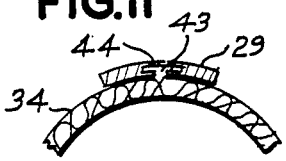
FIG. 11 is a cross sectional view taken at 11—11 of FIG. 10.
Figure 10:
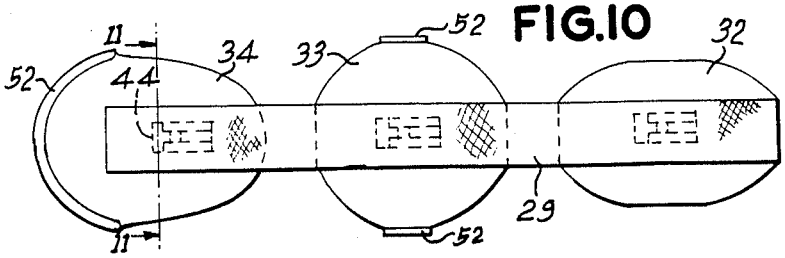
FIG. 10 is a top plan view of a fourth embodiment of a finger protective element.

The embodiment in FIGS. 10 and 11 is similar to that of FIGS. 8 and 9 except that the T-shaped tongues and grooves are reversed. Here the tongue 43 is attached to channel members 32, 33, and 34 while the cooperating T-shaped grooves are found in strip 29. This may require a thicker strip 29 than in the embodiment of FIGS. 8 and 9, but otherwise the functioning is identical.

Figure 15:
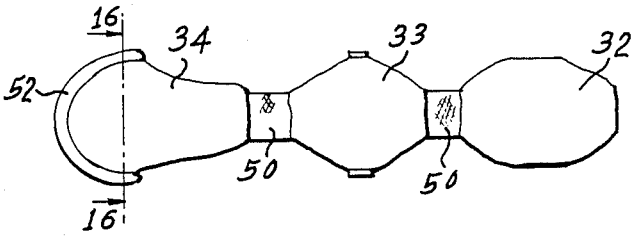
FIG. 15 is a top plan view of a sixth embodiment of a finger protective element.
Figure 16:
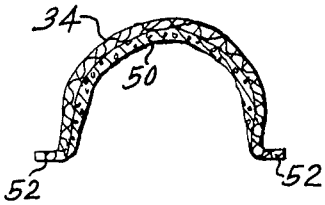
FIG. 16 is a cross sectional view taken at 16—16 of FIG. 15.

Another embodiment is shown in FIGS. 15 and 16 wherein a continuous layer of elastic foam material 50 is formed on the inside surfaces of members 32, 33, and 34 and extended between adjacent members 32, 33, and 34 to form one unit. This embodiment can be used in the gloves shown in FIGS. 1 and 2 or 13. It can also be used in a commercially available work glove having no pockets 24, 25, or 46. The protective elements whether separate units as described above with respect to FIGS. 1–6 or as an articulated unit described with respect to FIGS. 12–14 may be used in many types of gloves. It may, of course, be necessary to employ a slightly larger glove to accommodate the protective unit and the hand of the wearer if the elements like those shown in FIGS. 15 and 16 are used inside a glove. The foam layer provides a cushion between the fingers and the protective unit as well as providing the flexible connection needed for an articulated structure.

The protective members 32, 33, 34, 37, 38 and 39 may be made of metal, plastic, or any other light weight stiff material. Aluminum is one suitable material, and a PVC material and a fiber-reinforced plastic are also suitable materials. Flexible connector strip 29 may be any cloth or plastic strip, e.g., polyolefin, nylon, polycarbonate, or the like. Foam layer 50 may be any plastic or elastic foam having good tear resistance, e.g., polyolefin foam, rubber foam, nylon foam, or the like.

It is to be noted that in some of these embodiments it may be preferable to tack by sewing through the outer material 24 about or through the flexible material such as between portions 33 and 34 so that the end cup 34 is accurately positioned in the glove.

Another embodiment is to sew flanges 52 to the leather palm 31 of the glove to positively locate members 33 and 34. In this embodiment members 32 would have to be located by sewing or adhesively attaching member 32 to the pocket 24 of each finger, respectively.

FIG. 17 illustrates a second embodiment wherein the articulated protective elements (as shown in FIG. 12) are held in the glove in one large pocket 53 which encompasses all fingers as well as the back of the hand with an elastic tape 26 to hold the elements in place. If desired the thumb element may also be included.

Still another embodiment is illustrated in FIG. 18 wherein a thin fabric or mesh glove 54 has each of the finger channel members 32, 33, and 34 and the hand member 37 are attached to the outside back of glove 54 by any convenient means, e.g., sewing, gluing, welding, or the like. This eliminates the need for flexible connector 29. The liner glove 54 with protective members attached is fitted onto the hand first and then a work glove fitted over the liner glove 54. This may require a slightly larger work glove to accommodate the liner glove 54. An alternative embodiment is to make the work glove with a fabric or mesh back side to which the protective elements are attached. This would eliminate the need for a complete liner glove 54 and would incorporate the same features in a work glove. Elements 32, 33, 34, and 37 could be left uncovered on the back of the glove or an outside layer of canvas could be added as in FIGS. 1–5 to cover those elements.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A protective work glove comprising a glove having internal cavities for fingers and hand of a wearer with finger and hand protective members cooperating therewith on the back and sides of the fingers and the back of a hand, said finger protective members each including a plurality of stiff spaced channel members adapted to fit around the back of and sides of and along the phalange of each finger and held in place between the knuckles of the finger, and said hand protective member including a curved stiff plate member adapted to fit over the back of the hand between the wrist and the fingers, at least said channel member overlying the outermost phalange of each finger having a height greater than the height of such phalange to inhibit crushing of such phalange.

2. The glove of claim 1 wherein said finger protective members are disconnected from each other.

3. The glove of claim 1 wherein said finger protective members are joined together with a flexible connector to produce an articulated finger element.

4. The glove of claim 3 wherein said finger protective members and said hand protective member are joined into one articulated unit.

5. The glove of claim 1 wherein said finger and hand protective members are insertable into said internal cavities that the fingers and hand are inserted in wearing the glove.

6. The glove of claim 1 wherein said finger and hand protective members are inserted into pockets on the back of the glove separate from said cavities in the glove for the fingers and hand.

7. The glove of claim 3 wherein said stiff channel members and said flexible connector are held together by an adhesive means.

8. The glove of claim 3 wherein said stiff channel members and said flexible connector are held together by a sliding connection including a T-shaped tongue and a groove for said tongue.

9. The glove of claim 3 wherein said flexible connector is a separate strip attached to each said channel member.

10. The glove of claim 3 wherein said flexible connector is a plastic-elastic foam layer lining each said channel member and extending between adjoining said channel members.

11. The glove of claim 1 further comprising connecting means for attaching together said finger protective members covering a respective phalange.

12. The glove of claim 11 wherein said connecting means attaches together all of said finger protective members.

13. The glove of claim 12 wherein said connecting means attaches said plate member to the adjacent said finger protective members of each phalange.

14. The glove of claim 11 wherein said connecting means is flexible.

15. The glove of claim 11 wherein said connecting means is bendable.

16. The glove of claim 11 wherein said glove includes a plurality of outer pockets over said finger cavities for accommodating said finger protective elements.

17. The glove of claim 16 wherein said glove includes an enlarged outer pocket for accommodating said plate member.

18. The glove of claim 17 wherein said plurality of pockets and said enlarged pocket communicate and form a substantially outer back side for said glove.

19. A work glove with protective members insertable therein and adapted to prevent bruising or crushing injury to the fingers and hand, said glove comprising a work glove with pockets attached to the back of said glove to receive said protective members, said protective members comprising a plurality of finger protective members each including a plurality of stiff spaced channel members adapted to fit around the phalanges of the finger and adapted to be positioned and maintained in said pockets along the fingers to accommodate the bending of the finger, said members further comprising a hand protective member including a stiff curved plate member adapted to fit over the back of the hand substantially between the knuckles and the wrist, at least said channel member overlying the outermost phalange of each finger having a height greater than the height of such phalange to inhibit crushing thereof.

20. The glove of claim 19 wherein said finger protective members and said hand protective member are separate and unconnected to each other.

21. The glove of claim 19 wherein three of said finger protective members are joined to each other by a flexible connector to produce a single protective element for each finger.

22. The glove of claim 19 wherein said finger protective members and said hand protective member are joined together by a plurality of flexible connectors to produce a single protective element for the hand and fingers.

23. The glove of claim 21 wherein said channel members and said flexible connector are joined by means including a T-shaped tongue and a groove for slidably receiving said tongue.

24. The glove of claim 22 wherein each said flexible connector is a strip of flexible plastic extending from said protective member overlying a respective tip of a finger to the remaining said finger channel members and to said hand protective member.

25. A protective work glove for a hand of a user comprising a glove having a plurality of finger and thumb cavities communicating with and extending outwardly from a major cavity which receives the remainder of the hand between the wrist and fingers, finger protective members carried by said glove in superposed relation to the back side of the respective fingers, said finger protective members each including a plurality of stiff channel shaped members overlying the back side of the phalange of each finger, at least said stiff channel shaped members overlying the outermost phalange of each finger having a height greater than the height of such phalange to inhibit crushing of such phalange, and a curved stiff plate protective member carried by said glove in superposed relation to the back of the hand between the wrist and the knuckles and covering substantially the back of the hand of a wearer.

26. The glove of claim 25 wherein said channel shaped members and plate protective members are attached to a thin fabric liner glove which in turn is insertable into said work glove thereby sandwiching said liner glove between said work glove and a hand of a wearer.

27. The glove of claim 25 wherein said channel shaped members and plate protective members are affixed to a thin flexible fabric to hold said members in place over the phalanges of the fingers and the back of the hand, said fabric with said members attached being positionable in said work glove to maintain said members in protective positions overlying the fingers and the back of the hand.

28. The glove of claim 27 wherein said channel shaped members and the plate protective members are affixed to a thin flexible fabric to hold said members in place over the phalanges of the fingers and the back of the hand, said fabric with said members attached being incorporated into the back of said work glove.

29. The glove of claim 25 further comprising at least one thumb protective member overlying at least the back of the thumb.

30. The glove of claim 25 wherein said finger protective members and plate member are connected to the back side of said glove.

31. The glove of claim 25 wherein said finger protective members and plate member are connected to a liner glove insertable into said glove.

32. The glove of claim 25 wherein said finger protective members and plate member are respectively connected within said finger cavities and said major cavity.

33. The glove of claim 32 wherein a plastic-elastic foam layer lining is applied to said finger protective members and said plate member adjacent the fingers and hand.

34. A protective work glove comprising a glove having internal cavities for fingers and hand of a wearer with finger and hand protective members cooperating therewith on the back and sides of the fingers and the back of the hand, said finger protective members each including a plurality of spaced stiff channel members adapted to fit around the back of and sides of and along the phalange of each finger and held in place between the knuckles of the finger, and said hand protective member including a curved stiff plate member adapted to fit over the back of the hand between the wrist and the fingers, at least some of said finger protective members are positioned adjacent respective tips of the fingers of a wearer, said some members being enclosed around the tips of the fingers.

35. A protective work glove comprising a glove having internal cavities for fingers and hand of a wearer with finger and hand protective members cooperating therewith on the back and sides of the fingers and the back of a hand, said finger protective members each including a plurality of stiff spaced channel members adapted to fit around the back of and sides of and along the phalange of each finger and held in place between the knuckles of the finger, and said hand protective member including a curved stiff plate member adapted to fit over the back of the hand between the wrist and the fingers, said channel members overlying each of the adjacent phalange to the outermost phalange has a height greater than the height of such phalange to inhibit crushing of such phalange.

* * * * *